United States Patent [19]

Goto

[11] Patent Number: 5,044,996

[45] Date of Patent: Sep. 3, 1991

[54] WEDGE CONNECTOR

[75] Inventor: Kazuhiro Goto, Markham, Canada

[73] Assignee: AMP Incorporated, Harrisburg, Pa.

[21] Appl. No.: 665,387

[22] Filed: Mar. 6, 1991

[51] Int. Cl.[5] ..... H01R 4/50

[52] U.S. Cl. ..... 439/783

[58] Field of Search ..... 439/783, 863

[56] References Cited

U.S. PATENT DOCUMENTS

| | | | |
|---|---|---|---|
| 3,065,449 | 11/1962 | Matthysse et al. | 439/783 |
| 4,723,921 | 2/1988 | Pooley | 439/783 |
| 5,006,081 | 4/1991 | Counsel et al. | 439/783 |

*Primary Examiner*—Paula A. Bradley

*Attorney, Agent, or Firm*—Allan B. Osborne

[57] ABSTRACT

A wedge connector (10) for commoning a pair of wires (64,66) has been disclosed. The connector (10) includes a wedge (12) which is inserted into a C-member (14) to engage and common the wires (64,66) positioned in respective channels (48) in the C-member (14). The connector (10) further includes a deformable tab (54) for receiving a jaw (70) of a plier-type wedge (12) into the C-member (14). The tab (54) deforms when a predetermined insertion force is reached.

10 Claims, 3 Drawing Sheets

WEDGE CONNECTOR

FIELD OF THE INVENTION

This invention relates to wedge connectors for electrically commoning and mechanically securing two electrical wires.

BACKGROUND OF THE INVENTION

Electrical connectors of the type having a C-shaped body member having converging channels and a complementary wedge member have been known from at least as early as April 21, 1931. When U.S. Pat. No. 1,801,277 issued to W. G. Kelley on an application filed May 18, 1926. Subsequent thereto a large number of patents disclosing different and improved embodiments have issued, including more recently U.S. Pat. Nos. 4,415,222 and 4,600,264. In each of the disclosures, the basic Kelley concept was followed; i.e., two conductors are electrically commoned and mechanically secured by being pressed into and against interior curved surfaces or channels provided in a C-shaped body member by a wedge being driven longitudinally into the body member between the conductors.

These known wedge connectors have been very successfully used in the power utility industry for a number of years for large diameter cable where the C-members are massive enough to exert a resilient, compressive force against the cables trapped in the channels by the wedge. It is now proposed to provide a wedge connector for smaller diameter wire wherein the force required to drive the wedge into the C-member is controllable and where the wedge cannot back out of the C-member.

SUMMARY OF THE INVENTION

According to the present invention, a wedge connector for commoning a pair of wires by inserting a wedge in between the wires positioned in channels on each side of a C-member. The wedge and C-member include supports for receiving the jaws of plier-type tool used to insert the wedge into the C-member. The support on the C-member is deformed when a predetermined insertion force is reached and can no longer support the jaw.

DESCRIPTION OF THE INVENTION

Figure 1:
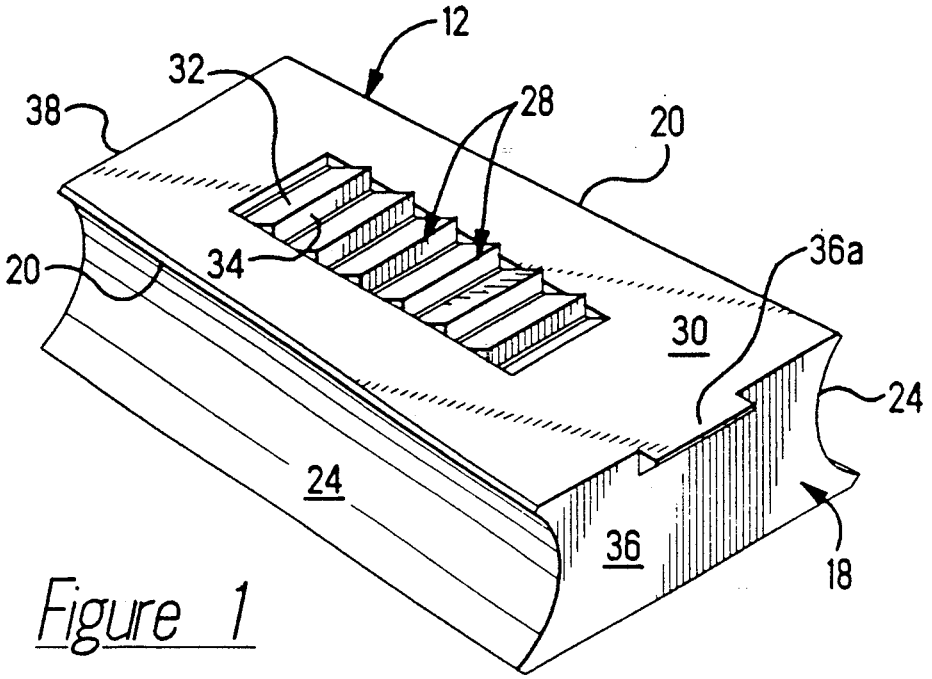
FIG. 1 is a perspective view of a wedge of the wedge connector of the present invention.

Wedge connector 10 (shown assembled in FIG. 3) includes wedge 12 shown in FIG. 1A and C-member 14 shown in FIG. 1B. Both components 12,14 have a complementary wedge shape; i.e., the respective sides converge from one end to the other. However, the degree of convergence of one component does not necessarily need to be identical to that of the other.

Wedge 12 includes body member 18 having converging sides 20 provided with outwardly facing concave grooves 24. Grooves 24 can be but need not have the same radius of curvature; i.e., one may be sized differently to receive a different diameter wire than the other.

A number of teeth 28 are provided on and projected out of the plane of surface 30 of body member 18. Each tooth 28 is defined by a slanting first portion 32 and second portion 34 which is perpendicular to surface 30 (shown more clearly in FIGS. 2–4). Further, the teeth 28 are orientated normal to the length of wedge 12.

Wide or trailing end 36 of wedge 12 is preferably provided with ridge **36*a* adjacent surface 30. Narrow or leading end 38** may be of any shape.

Wedge 12 is preferably made by casting with the material being aluminum or copper alloy.

C-member 14 includes shell member 42 whose sides 44 have been rolled over web 46 to define channels 48. Channels 48 may be of equal or different sizes. Channels 48 and web 46 define therebetween space 50 which receives wedge 12.

Figure 2:
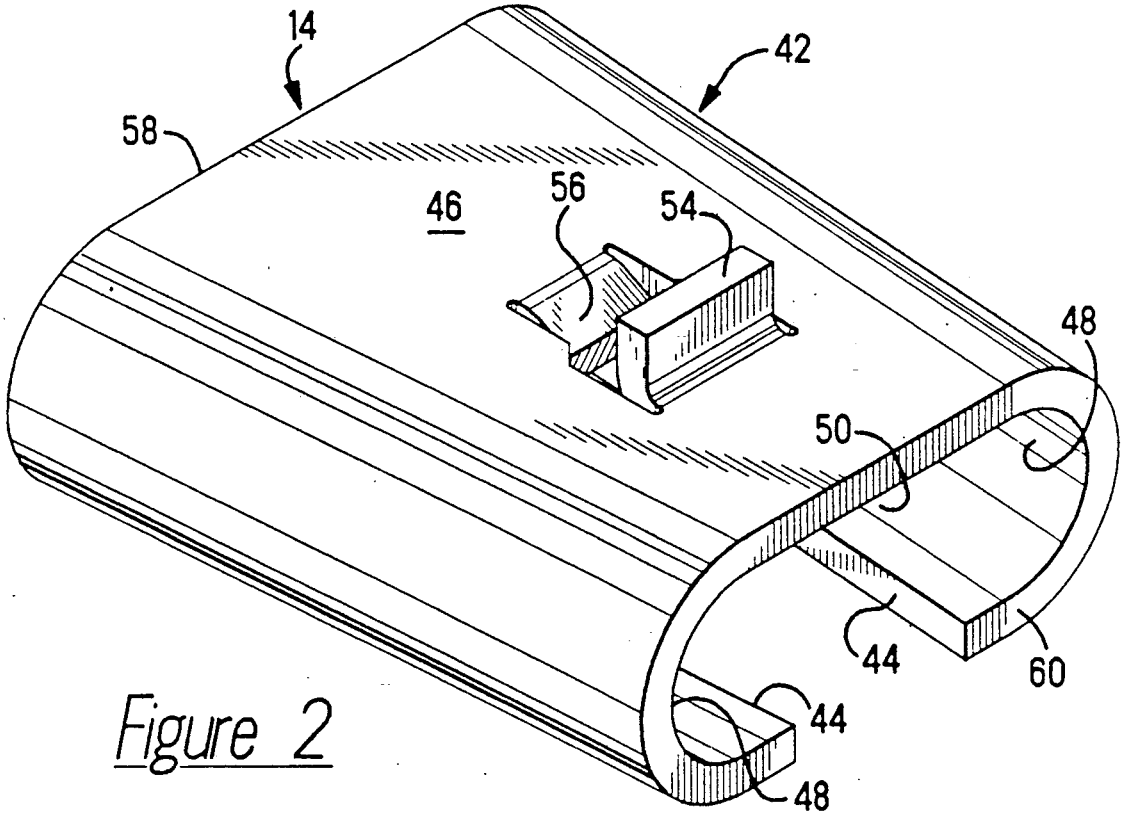
FIG. 2 is a perspective view of a C-member of the wedge connector of the present invention.

Tab 54, blanked out from web 46, protrudes outwardly therefrom. Lance 56, also blanked out from web 46, protrudes obliquely into space 50. As can be seen in FIGS. 1B and 2, lance 56 points away from the wide end 58 and towards narrow end 60 of C-member 14.

C-member 14 is preferably made by casting or forming with a suitable material being aluminum or copper alloy. Tab 54 and lance 56 are secondary operations. The use of either material provides resiliency to sides 44.

Figure 3:
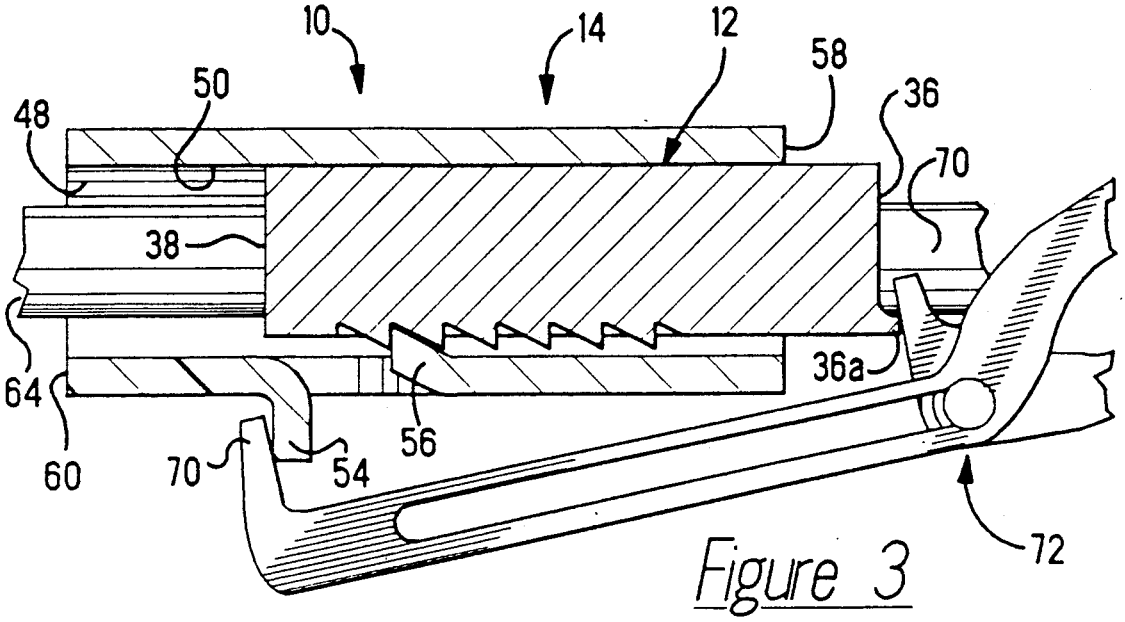
FIGS. 3, 4 and 5 are sectioned views showing the wedge being driven into the C-member.
Figure 4:
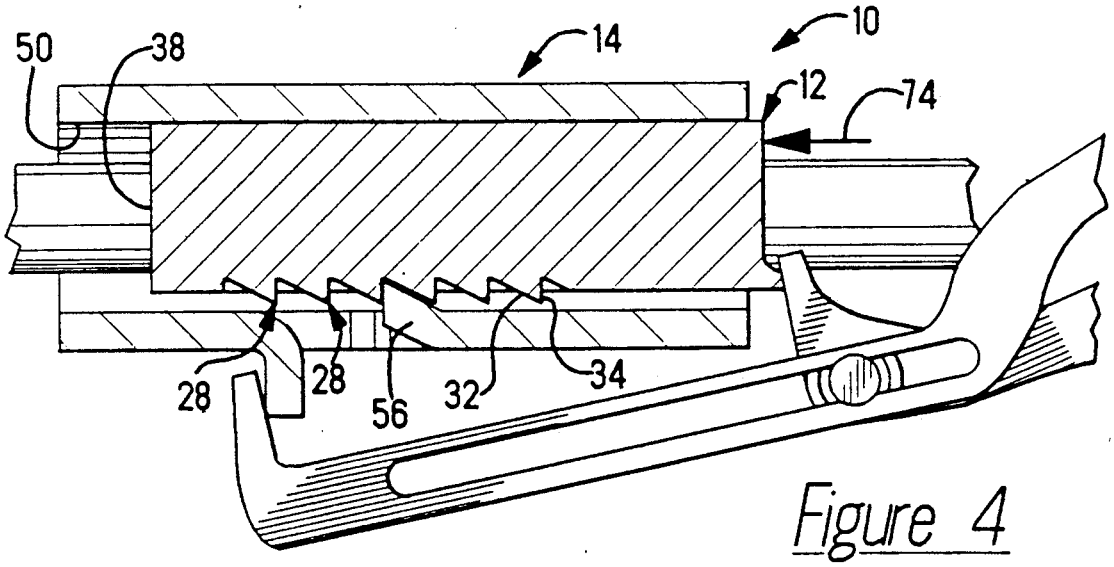

The assembly of wedge connector 10 and commoning of wires 64,66 is shown in FIGS. 2–4.

Wires 64,66 (only wire 64 is shown in FIGS. 2–4) are positioned in channels 48 and wedge 12 inserted by hand into space 50 through wide end 58 of C-member 14. Jaws 70 of channel-lock pliers 72 are positioned respectively behind tab 54 and trailing end 36 of wedge 12 as shown.

As jaws 70 are closed, wedge 12 is pushed further into space 50 as indicated by arrow 74 in FIG. 3. As this happens, lance 56 is resiliently pressed outwardly by slanted first portions 32 of teeth 28 and then returns to abut second portion 34 to prevent wedge 12 from backing out under the compressive forces building up in wires 64,66 and in the resilient outward displacement of sides 44 of C-member 14.

As the insertion forces reach a predetermined level, tab 54 bends back in towards web 46 duplicated on wedge of C-member 14 as indicated by arrow 74 in FIG. 4. This bending in removes the support for one jaw 70 and the pliers 72 become disengaged. The assembly and wire commoning has been properly completed with excessive application force avoided. As noted above, lance 56, abutting a tooth 28, prevents wedge 12 from working back out.

Figure 5:
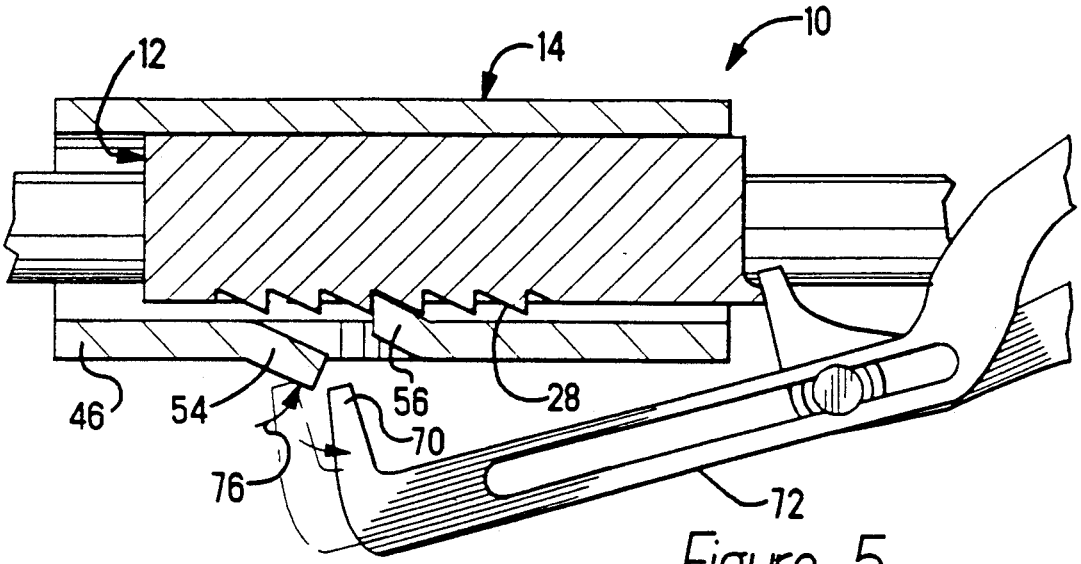
Figure 6:
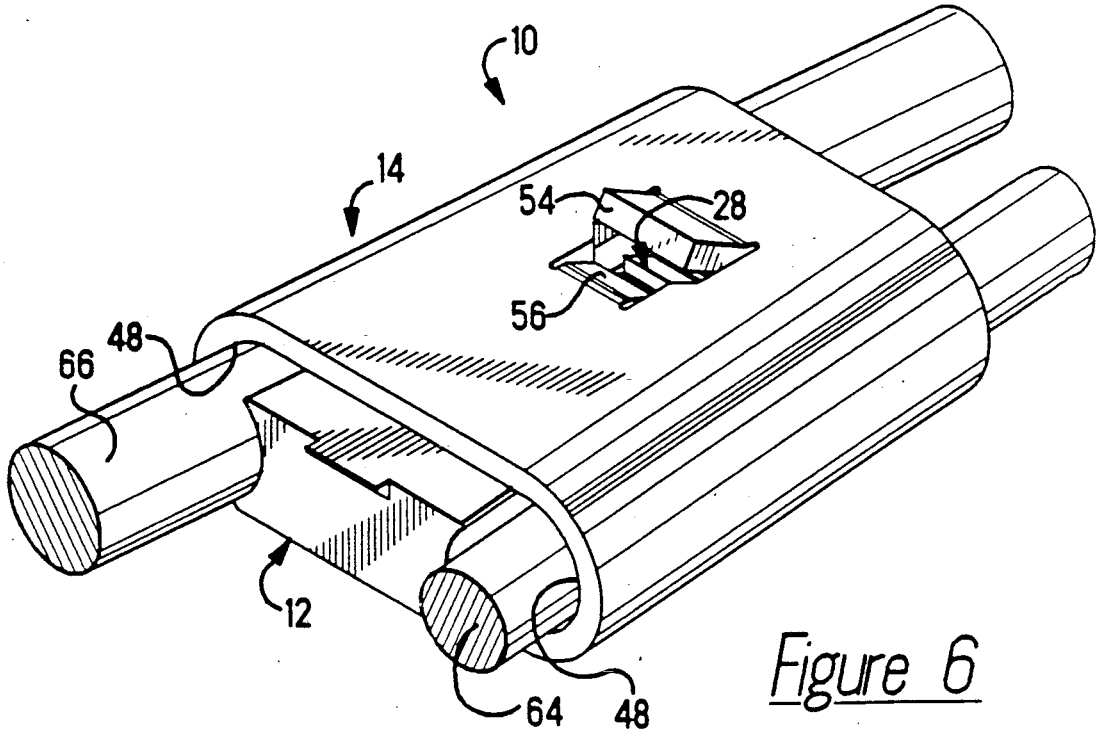
FIG. 6 is a perspective view showing a pair of wires commoned in the assembled wedge connector of the present invention.

FIG. 5 shows an assembled connector 10 with wires 64,66 commoned therein.

As can be discerned, a wedge connector has been disclosed wherein a deformable tab prevents excessive installation forces and where the wedge and C-member includes teeth and a lance respectively for cooperatively preventing the wedge from backing out of the C-member.

I claim:

1. A wedge connector for commoning a pair of wires, said connector comprising:

a C-member with rolled over edges providing a pair of wire-receiving channels opening into a space therebetween and a web attached to and extending between said rolled over edges;

a wedge for being inserted in between said channels to common wires which may be positioned therein, said wedge including one end adapted to provide support for one jaw of a compressing type tool; and deformable means on said C-member for providing support for another jaw of a compressing-type tool whereby said wedge may be forced into said C-member, said means adapted to deform when a predetermined force exerted thereagainst is reached.

2. The connector of claim 1 wherein said deformable means include a tab protruding outwardly therefrom.

3. The connector of claim 1 further including cooperating means on said wedge and said C-member for preventing separation of said wedge and C-member after assembly.

4. The connector of claim 3 wherein said cooperating means include a resilient lance on said C-member and saw teeth on said wedge.

5. A wedge connector for connecting a pair of electrical wires, said connector comprising:

a C-member formed by rolling opposing sides over a web extending therebetween to defined a pair of wire-receiving channels which open towards and face each other across a space defined by said channels and said web and having a lance protruding into said space at an oblique angle; and a wedge adapted to be inserted into said C-member to capture and common a pair of electrical wires which may be positioned in respective said channels, said wedge having saw teeth on one planar surface for cooperating with said lance to prevent withdrawal of said wedge from said C-member.

6. The wedge connector according to claim 5 further including cooperating means on said C-member and wedge for receiving jaws on a squeezing-type tool whereby said wedge may be inserted into said C-member.

7. The wedge connector according to claim 6 wherein said cooperating means includes a deformable means adapted to deform upon a predetermined insertion force being reached.

8. The wedge connector according to claim 6 wherein said cooperating means include a tab protruding outwardly from said C-member.

9. The wedge connector according to claim 8 wherein said tab deforms under a predetermined force being exerted on it through said squeezing-type tool.

10. The wedge connector according to claim 9 wherein said lance and said tab are blanked out from said web.

* * * * *